US005931078A

United States Patent [19]

Kropp

[11] Patent Number: 5,931,078

[45] Date of Patent: Aug. 3, 1999

[54] HYDROSTATIC DRIVE SYSTEM

[75] Inventor: Walter Kropp, Sulzbach am Main, Germany

[73] Assignee: Linde Aktiengesellschaft, Germany

[21] Appl. No.: 08/844,089

[22] Filed: Apr. 18, 1997

[30] Foreign Application Priority Data

Apr. 19, 1996 [DE] Germany ..... 196 15 593

[51] Int. Cl.[6] ..... F15B 13/02

[52] U.S. Cl. ..... 91/446; 91/448

[58] Field of Search ..... 60/452, 422; 91/446, 91/448

[56] References Cited

U.S. PATENT DOCUMENTS

| | | | |
|---|---|---|---|
| 4,738,279 | 4/1988 | Kropp | 137/596 |
| 5,083,430 | 1/1992 | Hirata et al. | 91/448 |
| 5,146,747 | 9/1992 | Sugiyama et al. | 91/446 |
| 5,533,334 | 7/1996 | Takeuchi et al. | 91/446 |

*Primary Examiner*—Sheldon J. Richter
*Attorney, Agent, or Firm*—Webb Ziesenheim Logsdon Orkin & Hanson, P.C.

[57] ABSTRACT

A hydrostatic drive system has a demand-responsive pump and at least one hydraulic circuit or consumer connected to it. Each consumer can be actuated by a directional control valve which acts as a throttle in intermediate positions. For the distribution of the delivery flow independently of the load, a pressure-maintaining valve is located upstream of the directional control valve. The pressure-maintaining valve can be controlled by a differential signal formed from a load pressure signal and a delivery pressure signal. The load pressure signal to the pressure-maintaining valve of the consumer can be changed by the output signal of a pressure reducing valve. One control surface of the pressure-maintaining valve can be pressurized with the output-side pressure of the pressure reducing valve which is located in a load pressure line. The output pressure of the pressure reducing valve can be adjusted by a spring and a variable control pressure.

7 Claims, 1 Drawing Sheet

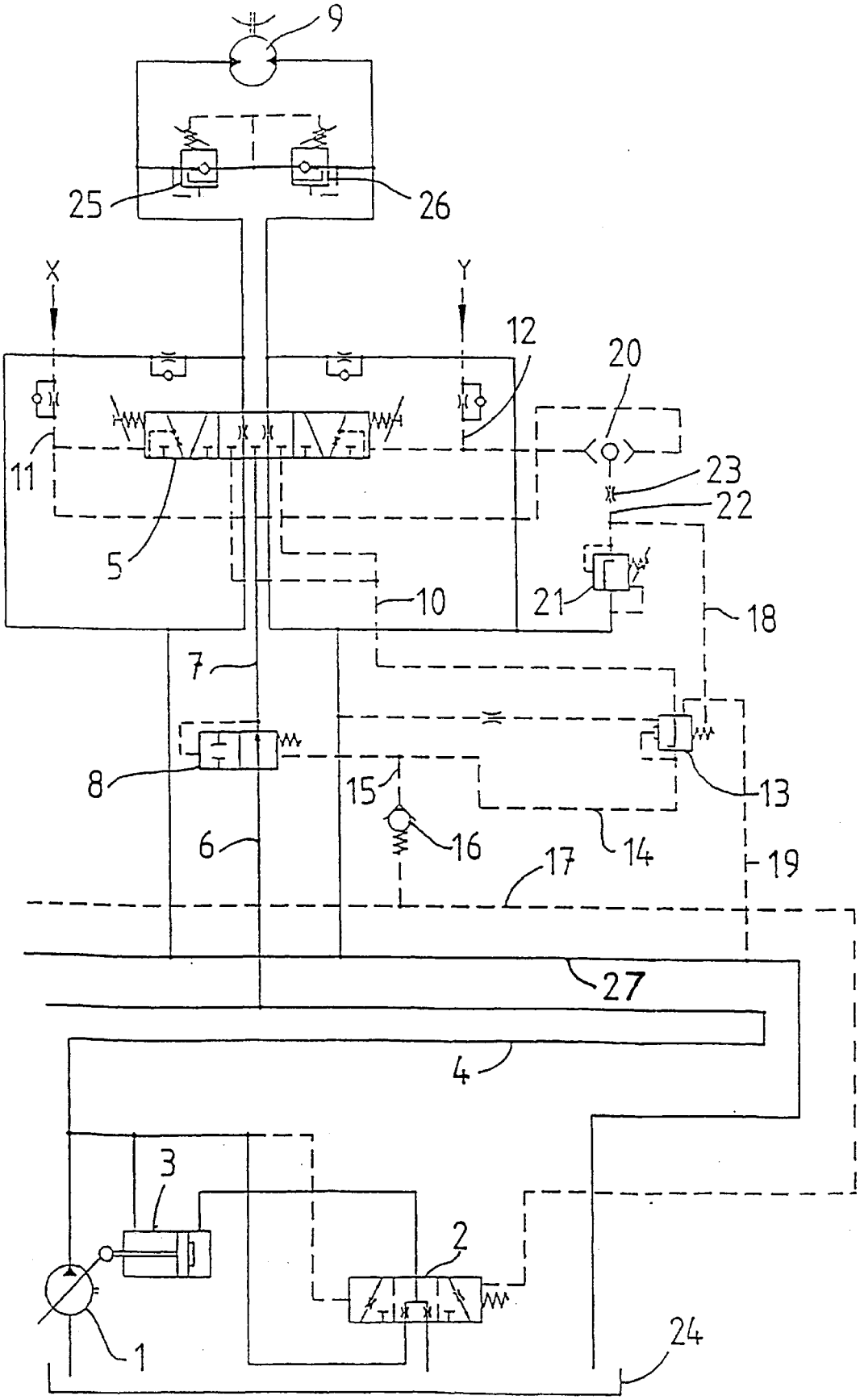
9
25
26
X
Y
12
20
11
23
22
5
21
10
18
7
8
15
13
16
14
6
17
19
27
4
3
2
1
24

HYDROSTATIC DRIVE SYSTEM

BACKGROUND OF THE INVENTION

1. Field of the Invention

This invention relates to a hydrostatic drive system with a demand-responsive pump and at least one hydraulic circuit or consumer connected to it. Each consumer can be actuated by a directional control valve which acts as a throttle in intermediate positions. The system includes a pressure-maintaining valve for the distribution of the delivery flow to the directional control valve independently of the load. The pressure-maintaining valve can be controlled by a differential signal which is formed from a load pressure signal and a delivery pressure signal.

2. Background Information

In drive systems to which the present invention relates, the volume flow which flows to the consumer (or hydraulic circuit) is determined independently of its load pressure by the opening width of the directional control valve. The volume flow which flows to the consumer is thereby proportional to the speed of movement of the consumer. To achieve a distribution of the delivery flow which is independent of the load when a plurality of consumers are connected, pressure-maintaining valves are located upstream of the directional control valves. The speed of movement of the consumer can therefore be controlled or regulated. In such drive systems of the prior art, there is no control of the drive force for consumers which work in translation movements or of the drive torque for consumers which work in rotational movements.

Prior art document DE-OS 36 43 110 discloses that the pressure of the hydraulic medium which flows to the consumer can be limited as a function of the displacement distance of the directional control valve, which does not have a pressure-maintaining valve to divide the delivery flow independently of the load. The prior art document teaches that a fixed throttle and a throttle which is variable as a function of the displacement of the directional control valve can be located in the control pressure signal line. When such a directional control valve is present, the pressure medium flows to a consumer at a pressure which is a function of the displacement of the directional control valve. The torque of a consumer with a rotating output shaft can thereby be specified by the displacement of the directional control valve. In this case, however, the load pressure signal is derived from the delivery flow of the pump, and is connected to a tank by means of the variable throttle. To generate the torque control in the directional control valve, a portion of the delivery flow is thereby converted into heat and into lost power. During simultaneous operation of an additional consumer which has a higher load pressure, the torque control mechanism is deactivated. The higher delivery flow which occurs at the pump on account of the higher load pressure signal, and thus also the higher delivery pressure, is reduced by the pressure relief valves which correspond to the consumer. The torque limitation control is thereby not operational under all operating conditions, and also entails losses in the pump delivery flow.

The object of the invention is to make available a hydrostatic drive system of the type described above which avoids the previous limitation of the force and/or torque of the consumer.

SUMMARY OF THE INVENTION

The present invention provides that the above object can be accomplished if the load pressure signal to the pressure-maintaining valve of the consumer can be modified by the output signal of a pressure reducing valve. The pressure-maintaining valve, which is present for the distribution of the delivery flow independently of the load, is also used to regulate the drive force or the drive torque. It is thereby possible to control the speed of movement of the consumer independently of the load, and also, by influencing the load pressure signal to the pressure-maintaining valve, to control the drive force or the drive torque of the consumer.

In one embodiment of the invention, the control surface of the pressure-maintaining valve which is active in the opening direction can be pressurized with the output-side pressure of a pressure reducing valve which is located in a load pressure line. The output pressure of the pressure reducing valve can be set or adjusted by a spring and a variable control pressure. The sum of the forces of the spring force and the force on a control piston of the pressure reducing valve resulting from the control pressure thereby determines the maximum level of the output pressure of the pressure reducing valve. The variable control pressure, which acts on the spring side of the pressure reducing valve, and the spring force represent the set point at which the output pressure of the pressure reducing valve, and thus the drive force or the drive torque of the consumer, are to be set.

The variable control pressure can be generated in any appropriate manner. However, the directional control valve, which acts as a throttle in the intermediate position, may be actuated bilaterally by pressure in a control pressure line. A shuttle valve in the control pressure line transmits the respective maximum control pressure to a control pressure branch line in which, downstream of the shuttle valve, there are a throttle and a pressure relief valve. The pressure relief valve limits the respective control pressure selected by the shuttle valve by an adjustable spring and feeds this pressure into a control pressure signal line which is connected to the pressure reducing valve. The level of the variable control pressure is thereby limited and is transmitted to the pressure reducing valve. The level of the drive force or the drive torque is regulated as a function of the control pressure, which acts on the directional control valve and by the pressure relief valve. The control pressure can be easily generated if it is made available from a control pressure source which is already present in the hydrostatic drive system.

The pump may be provided with a demand-responsive regulation system which is effectively connected to a load sensing line (LS line) which supplies a plurality of consumers. The load pressure line leading from the pressure reducing valve to the pressure-maintaining valve is connected to the LS line by a branch line. A non-return or one-way valve located in this branch line opens toward the demand-responsive regulator. As a result of this configuration, it is possible to regulate the drive force or the drive torque of the consumer even during the operation of a simultaneously connected additional consumer which has a higher load pressure.

The additional expense and effort required to achieve the present invention are small, if the pressure reducing valve is a three-way pressure reducing valve, and is connected to a tank by an outlet line. The output pressure at the pressure reducing valve is thus kept constant. In the event of an increase of the output pressure beyond the set point set on the pressure reducing valve, the pressure reducing valve limits the output pressure to the specified set point by discharging the excess output pressure to the tank. The load pressure signal to the pressure-maintaining valve is therefore kept constant, even in the event of the action of a higher delivery flow signal during the operation of a simultaneously connected consumer, whereby the pressure-maintaining valve is switched into a pressure reducing position. As a result of this configuration of the invention, the torque of the consumer is limited to the set point specified as a function of the control pressure at the directional control valve. It is thereby possible to prevent a portion of the delivery flow and delivery pressure from being converted into lost power by the pressure relief valves corresponding to the consumer.

The invention can be advantageously used in a propulsion system with a bilaterally activated consumer in the form of a hydraulic motor, preferably driving an excavator slewing gear. In this particular application, a torque regulation capability is advantageous.

Additional details and advantages of the invention are explained in greater detail below with reference to the embodiment which is illustrated in the accompanying schematic drawing.

BRIEF DESCRIPTION OF THE DRAWING

The figure is a schematic circuit diagram of a hydrostatic drive system according to the present invention.

DESCRIPTION OF THE PREFERRED EMBODIMENT

A pump 1, the delivery volume of which can be adjusted, has a demand-responsive regulator 2 which pressurizes a variable piston 3 to adjust the delivery volume of the pump 1. The pump 1 is connected to the hydraulic circuit or consumers 9 by means of a delivery line 4. A directional control valve 5 is connected to the delivery line 4 by delivery branch lines 6, 7. Between the delivery branch lines 6 and 7, and upstream of the directional control valve 5, there is a pressure-maintaining valve 8, the purpose of which is to distribute the delivery flow independently of the load. The pressure-maintaining valve 8 has an open position and a closed position. Connected to the directional control valve 5 is a hydraulic circuit or consumer 9 which, in this embodiment, is a hydraulic motor. The hydraulic motor can be operated in two directions and is preferably used as the propulsion system to drive the slewing gear of an excavator. To protect the hydraulic motor, there are pressure relief valves 25, 26, one for each direction of movement.

The pressure-maintaining valve 8 can be controlled by a differential signal formed from a delivery pressure signal and a load pressure signal. To respond to this pressure difference, the pressure-maintaining valve 8 has a control surface which acts in the closing direction and can be pressurized with a delivery pressure which is present in the delivery branch line 7 upstream of the directional control valve 5. A control surface of the pressure-maintaining valve 8 which acts in the opening direction can be pressurized with a spring and a load pressure formed downstream of the directional control valve 5 in the load pressure line 10. Normally, this load pressure is the highest load pressure of the consumer 9 which is connected downstream of the directional control valve 5.

The directional control valve 5 can be actuated hydraulically, in which case control pressures X or Y in control pressure lines 11, 12 are connected to corresponding active surfaces on the directional control valve 5.

When the consumer 9 is actuated, a connection is created from the pump 1 to the consumer 9. The pressure which builds up downstream of the directional control valve 5 is transmitted by the load pressure lines 10 and an LS line 17 to the demand-responsive regulator 2, as a result of which the equilibrium which prevails on the latter is disrupted, and the pump 1 is actuated to bring about an increase in the delivery volume and an increase in the delivery pressure. If the delivery pressure exceeds the moment of inertia on the hydraulic motor, consumer 9, the latter is set in motion. The opening released on account of the control pressure X or Y thereby acts as a measuring throttle, on which a specified pressure reduction of the delivery flow can be set. The pump 1 increases the delivery volume until the pressure decreases as the measuring throttle of the directional control valve 5 corresponds to the spring bias of the demand-responsive regulator 2. The speed of movement at the consumer 9 is therefore a function of the delivery volume of the pump 1, which in turn is a function of the displacement of the directional control valve 5.

When an additional consumer—not shown in the figure—is turned on, the load pressure of which exceeds that of the consumer 9, the pump 1 increases the delivery volume corresponding to the demand of the newly-connected consumer. To prevent an increase in the speed of movement of the consumer 9, the pressure-maintaining valve 8 throttles the hydraulic medium flowing to the directional control valve 5 until the pressure decreases as the measurement throttle of the directional control valve 5 corresponds to the original value. The speed of movement of the consumer 9 is therefore independent of its own load pressure and independent of the load pressure of any additional consumers which may be connected.

The present invention provides a pressure reducing valve 13 in the load pressure line 10 of the consumer 9 leading to the demand-responsive regulator 2. On the input side, the pressure reducing valve 13 is connected to the load pressure of the consumer 9 conducted in the load pressure line 10. The pressure to be set at the output is connected by a load pressure line 14 to the control surface in the opening direction of the pressure-maintaining valve 8, and is transmitted by means of a non-return or one-way valve 16 of the LS line 17 located in a branch line 15, and thus to the demand-responsive regulator 2 of the pump 1. The level of this pressure which occurs at the output of the pressure reducing valve 13 can be modified by a spring and a variable control pressure in a control pressure signal line 18. For this purpose, there is a shuttle valve 20 in the control pressure lines 11, 12 which are provided for the pressurization of the directional control valve 5. The shuttle valve 20 connects the control pressure lines 11, 12 with a control pressure branch line 22. Downstream of the shuttle valve 20, there are a throttle 23 and a pressure relief valve 21 in the control pressure branch line 22. The control pressure signal line 18 thereby branches off from the control pressure branch line 22.

When the consumer 9 is actuated, a control pressure X or Y acts on the directional control valve 5, and simultaneously via one of the control pressure lines 11, 12, the shuttle valve 20 and the throttle 23, on the pressure relief valve 21, and via the control pressure signal line 18 on the pressure reducing valve 13. The maximum protection pressure of the pressure relief valve 21, and thus the maximum control pressure which occurs in the control pressure signal line 18 at the pressure reducing valve 13, is defined by an adjustable spring. The load pressure which builds up as a result of the load on the consumer 9 downstream of the directional control valve 5 is applied by the load pressure line 10 to the input side of the pressure reducing valve 13. If this load pressure exceeds the control pressure on the pressure reducer valve 13, which corresponds to the spring force and is transported in the control pressure signal line 18, the output-side pressure in the load pressure line 14 which is connected to the opening direction of the pressure-maintaining valve 8 is reduced to the specified value. The pressure reducing valve 13 thereby acts as a pilot stage for the pressure relief function on the pressure-maintaining valve 8. Therefore no losses occur as a result of a pilot flow derived from the delivery flow of the pump 1.

If the delivery pressure in the delivery flow line 7, which is proportional to the drive torque of the consumer 9, exceeds the output-side pressure of the pressure reducing valve 13, the pressure-maintaining valve 8 moves in the closing direction, and prevents an increase of the delivery pressure and thus of the torque on the consumer 9. The equilibrium on the pressure-maintaining valve 8 is thereby determined by the level of the output-side pressure on the pressure reducing valve 13. The latter pressure can in turn be limited by the control pressure of the directional control valve 5 which is transported in the control pressure signal line 18 and protected by the pressure relief valve 21. The level of the delivery pressure of the pump 1 and thus the torque on the consumer 9 are a function of the level of the control pressure on the directional control valve 5, which also controls the opening width of the directional control valve 5 and thus the speed of movement of the consumer 9.

During the simultaneous operation of a consumer with a higher load pressure, this load pressure is transmitted via the LS line 17 to the demand-responsive regulator 2, and displaces the pump 1 to a correspondingly higher delivery volume. The level of the load pressure signal present at the pressure-maintaining valve 8 in the load pressure line 14 is not changed, however, on account of the non-return or one-way valve 16 located in the branch line 15. The delivery pressure of the connected consumer which is present under these operating conditions in the delivery flow branch lines 6, 7 and exceeds the maximum pressure set on the pressure-maintaining valve, causes the pressure-maintaining valve 8 to be moved in the closing direction.

The effort and expense required are small, if the pressure reducing valve 13 is a three-way pressure reducing valve and is connected by an outflow line 19, 27 to a tank. Consequently, the load pressure in the load pressure line 14 cannot exceed the value set on the pressure reducing valve 13, as a result of which the torque on the consumer 9 is not changed.

This arrangement has the advantage that under these operating conditions, the increased delivery pressure of the pump 1 is not reduced via the pressure relief valves 25, 26. Therefore there are no delivery flow losses of the pump 1.

While the invention is described in detail herein, it will be appreciated by those skilled in the art that various modifications and alternatives to the arrangement can be developed in light of the overall teachings of the disclosure. Accordingly, the particular arrangement is illustrative only and is not limiting as to the scope of the invention which is to be given the full breadth of the appended claims and any and all equivalents thereof.

What is claimed is:

1. A hydrostatic drive system comprising:

a demand-responsive pump;

at least one consumer connected to said pump;

a directional control valve actuating one consumer, said directional control valve acting as a throttle in intermediate positions and positioned between said pump and said one consumer;

a pressure-maintaining valve for controlling flow to said directional control valve, said pressure-maintaining valve controlled by a differential signal formed from a load pressure signal and a delivery pressure signal, said pressure-maintaining valve having a first control surface effective for moving said pressure-maintaining valve in a closing direction, said first control surface acted upon by said delivery pressure signal which is derived from a delivery pressure upstream of said directional control valve, said pressure-maintaining valve having a second control surface effective for moving said pressure-maintaining valve in an open direction, said second control surface acted upon by a spring and said load pressure signal; and a pressure reducing valve coupled to said pressure-maintaining valve, wherein said load pressure signal is modified from a load pressure downstream of said directional control valve by said pressure reducing valve.

2. The hydrostatic drive system as claimed in claim 1, wherein said second control surface of said pressure-maintaining valve is pressurized with an output pressure of said pressure reducing valve which is located in a load pressure line, and wherein said output pressure of said pressure reducing valve is adjusted by a spring and a variable control pressure.

3. A hydrostatic drive system comprising:

a demand responsive pump;

at least one consumer connected to said pump;

a directional control valve actuating said one consumer, said directional control valve acting as a throttle in intermediate positions and positioned between said pump and said one consumer;

a pressure-maintaining valve for controlling flow to said directional control valve, said pressure-maintaining valve controlled by a differential signal formed from a load pressure signal and delivery-pressure signal, said pressure-maintaining valve having a first control surface effective for moving said pressure-maintaining valve in a closing position direction, said first control surface acted upon by said delivery pressure signal which is derived from a delivery pressure upstream of said directional control valve, said pressure-maintaining valve having a second control surface effective for moving said pressure-maintaining valve in an open direction, said second control surface acted upon by a spring and said load pressure signal; and a pressure-reducing valve coupled to said pressure-maintaining valve, wherein said load pressure signal is modified from a load pressure downstream of said directional control valve by said pressure-reducing valve, wherein said second control surface of said pressure-maintaining valve is pressurized with an output pressure of said pressure-reducing valve which is located in the load pressure line, and wherein said output pressure of said pressure-reducing valve is adjusted by a spring in a variable control pressure, and wherein said directional control valve can be actuated bilaterally by pressure in control pressure lines, and further including a shuttle valve located in said control pressure lines.

4. A hydrostatic drive system comprising:

a demand responsive pump;

at least one consumer connected to said pump;

a directional control valve actuating said one consumer, said directional control valve acting as a throttle in intermediate positions and positioned between said pump and said one consumer;

a pressure-maintaining valve for controlling flow to said directional control valve, said pressure-maintaining valve controlled by a differential signal formed from a load pressure signal and delivery-pressure signal, said pressure-maintaining valve having a first control surface effective for moving said pressure-maintaining valve in a closing position direction, said first control surface acted upon by said delivery pressure signal which is derived from a delivery pressure upstream of said directional control valve, said pressure-maintaining valve having a second control surface effective for moving said pressure-maintaining valve in an open direction, said second control surface acted upon by a spring and said load pressure signal; and a pressure-reducing valve coupled to said pressure-maintaining valve, wherein said load pressure signal is modified from a load pressure downstream of said directional control valve by said pressure-reducing valve, wherein said second control surface of said pressure-maintaining valve is pressurized with an output pressure of said pressure-reducing valve which is located in the load pressure line, and wherein said output pressure of said pressure-reducing valve is adjusted by a spring in a variable control pressure, and wherein said directional control valve can be actuated bilaterally by pressure in control pressure lines, and further including a shuttle valve located in said control pressure lines, said shuttle valve transmitting the respective highest control pressure to a control pressure branch line, a throttle and a pressure relief valve in said control branch line wherein said pressure relief valve limits the level of the respective highest control pressure selected by said shuttle valve by an adjustable spring, wherein pressure from said pressure relief valve is fed into a control pressure signal line connected to said pressure reducing valve.

5. The hydrostatic propulsion system as claimed in claim 4, wherein said pump is connected to a demand-responsive regulator which is connected to a LS line and is provided to supply a plurality of consumers, whereby a load pressure line leading from said pressure reducing valve to said pressure-maintaining valve is connected to said LS line by a branch line, and wherein a non-return valve is located in said branch line and opens in the direction of said demand-responsive regulator.

6. The hydrostatic propulsion system as claimed in claim 5, wherein said pressure reducing valve is a three-way pressure reducing valve and is connected by an outlet line to a tank.

7. The hydrostatic propulsion system as claimed in claim 6, wherein said one consumer can be actuated bilaterally and is a hydraulic motor.

* * * * *

UNITED STATES PATENT AND TRADEMARK OFFICE

CERTIFICATE OF CORRECTION

PATENT NO. : 5,931,078

DATED : August 3, 1999

INVENTOR(S) : Walter Kropp

It is certified that error appears in the above-identified patent and that said Letters Patent is hereby corrected as shown below:

Column 5 Line 62 Claim 1 before "one consumer" insert --said--.

Signed and Sealed this

Fourteenth Day of December, 1999

*Attest:*

Q. TODD DICKINSON

*Attesting Officer*

*Acting Commissioner of Patents and Trademarks*